US009795259B2

(12) United States Patent
Helfrich

(10) Patent No.: US 9,795,259 B2
(45) Date of Patent: Oct. 24, 2017

(54) REMOVABLE TOILET SEAT LIFTER

(71) Applicant: Michael Helfrich, Annapolis, MD (US)

(72) Inventor: Michael Helfrich, Annapolis, MD (US)

( * ) Notice: Subject to any disclaimer, the term of this patent is extended or adjusted under 35 U.S.C. 154(b) by 230 days.

(21) Appl. No.: 14/565,041

(22) Filed: Dec. 9, 2014

(65) Prior Publication Data

US 2016/0157684 A1 Jun. 9, 2016

(51) Int. Cl.
*A47K 13/10* (2006.01)

(52) U.S. Cl.
CPC ..... *A47K 13/10* (2013.01)

(58) Field of Classification Search
CPC ..... A47K 13/10
USPC ..... 4/246.3, 246.1
See application file for complete search history.

(56) References Cited

U.S. PATENT DOCUMENTS 2,705,330 A 4/1955 Knudsen
2,776,440 A 1/1957 Miller
5,103,506 A 4/1992 Munford et al.
5,323,496 A 6/1994 Blair
5,404,595 A * 4/1995 Carmel ..... A47K 13/10 4/246.1
5,488,743 A 2/1996 Alfonso
5,713,084 A 2/1998 Greco
5,852,833 A * 12/1998 Gregoire ..... A47K 13/10 4/246.3
6,189,160 B1 2/2001 Pettus
6,393,623 B1 * 5/2002 Strickland, Jr. ..... A47K 13/10 4/246.3
7,281,277 B1 * 10/2007 Uchida ..... A47K 13/10 4/246.1
2012/0272443 A1 * 11/2012 Chamanara ..... A47K 13/10 4/246.3

OTHER PUBLICATIONS

PCT/US2015/064777 International Search Report and Written Opinion dated Feb. 12, 2016.

* cited by examiner

*Primary Examiner* — Huyen Le
(74) *Attorney, Agent, or Firm* — Michael Best & Friedrich, LLP

(57) ABSTRACT

An apparatus for raising and lowering a toilet seat that can easily be installed, for example by hand without tools, on a toilet, for example one that only has a seat and not a lid as commonly found in public venues. The apparatus includes a pedal base, a pedal, a seat bracket, and a lifter lever. The pedal is pivotally connected to the pedal base and coupled to the seat bracket so that movement of the pedal induces movement of the seat bracket and the lifter lever. The lifter lever is positioned under a toilet seat so that as the lifter lever is moved, the toilet seat is raised, and as the seat bracket rotates back down by reverse action on the pedal, the toilet seat is lowered.

18 Claims, 6 Drawing Sheets

REMOVABLE TOILET SEAT LIFTER

CROSS-REFERENCE TO RELATED APPLICATIONS

Related subject matter is disclosed in a further U.S. patent application filed concurrently herewith, by the same applicant, Ser. No. 14/564,976, titled "TOILET SEAT AND TOILET LID LIFTER AND REMOTE TOILET FLUSHER", the entire content of which is hereby incorporated by reference for all that is taught to provide greater detail or to describe additional aspects, but is in no way meant to limit or contradict the disclosure set forth herein or the construction of the appended claims.

BACKGROUND OF THE INVENTION

Field of the Invention

Various exemplary embodiments relate to devices for raising and lowering the seat of a commode or toilet.

Description of Related Art

Generally, toilet seats and/or lids vary greatly, from simple handles that are connected to the toilet seat, to complex mechanized and powered units. The former type does not totally eliminate unsanitary hand contact, nor does it eliminate possible arm, hand and back strain associated with manual operation. Mechanized and/or powered units often require complicated installation and/or permanent additions or modifications to the toilet, plumbing, and surrounding structure that are costly to manufacture and maintain.

SUMMARY OF THE INVENTION

In accordance with an exemplary embodiment, a toilet seat lifting device includes a pedal base, a pedal, a seat bracket, and a lifter lever. The pedal is pivotally connected to the pedal base. The seat bracket is mechanically connected to the pedal so that movement of the pedal induces movement of the seat bracket. The lifter lever is connected to, and extends outwardly from, the seat bracket.

In accordance with another exemplary embodiment, a toilet seat lifting device includes a pedal base, a mounting bracket, a pedal, a seat bracket, and a lifter lever. The pedal base has a first portion and a second portion extending from the first portion. The mounting bracket extends from the pedal base and has a slot. The pedal pivotally connects to the pedal base and has a bottom and a toe lip. The seat bracket is mechanically coupled to the pedal so that downward movement of the pedal induces movement of the seat bracket in a first direction and upward movement of the pedal induces movement of the seat bracket in a second direction. The lifter lever is connected to, and extends outwardly from, the seat bracket.

In accordance with additional exemplary embodiments is a combination toilet and toilet seat lifting device. The toilet has a toilet base, a toilet seat connected to the toilet base by a seat hinge, and a tank. The lifting device includes a pedal base, a mounting bracket, a pedal, a seat bracket, and a lifter lever. The mounting bracket extends from the pedal base and connects to the toilet base. The pedal pivotally connects to the pedal base. The seat bracket connects to the seat hinge and is coupled to the pedal so that movement of the pedal induces movement of the seat bracket. The lifter lever is connected to the seat bracket and is positionable under the toilet seat so that application of a force to the pedal causes movement of the toilet seat.

In accordance with a further exemplary embodiment, a device for raising or lowering a toilet seat includes a foot pedal disposed proximate a surface supporting a toilet. A linkage member mechanically attaches to the foot pedal at a first end thereof. An operating assembling mechanically attaches to said linkage member at a second end thereof. The operating assembly has a lifter for raising the toilet seat when the foot pedal is depressed and a closer for closing the toilet seat when the foot pedal is raised.

Various exemplary embodiments include a manually operated device to facilitate the desired raising and lowering of a toilet seat and lid through the application of downward and upward force applied to a single pedal. According to various embodiments, when the pedal is depressed by the foot the seat is raised. Upward force on the pedal lowers the seat.

BRIEF DESCRIPTION OF THE DRAWINGS

The above aspects and features of the present invention will be more apparent from the description for the exemplary embodiments of the present invention taken with reference to the accompanying drawings, in which:

FIG. 8B is an enlarged view of the circled area of FIG. 8A around an indent;

FIG. 8C is an enlarged view of the circled area of FIG. 8A around the rear of the seat bracket.

DETAILED DESCRIPTION OF EXEMPLARY EMBODIMENTS

Figure 1:
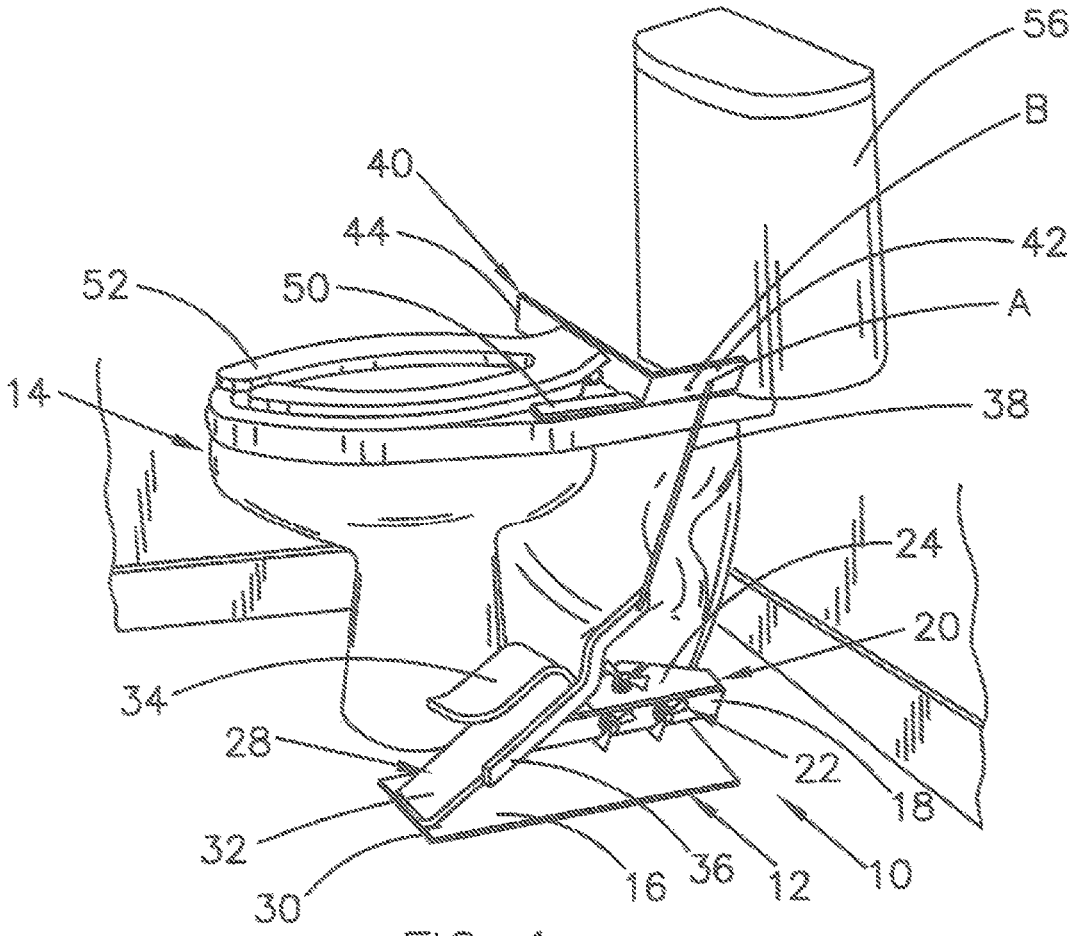
FIG. 1 is a perspective view of a lifter device connected to a toilet in accordance with an exemplary embodiment.
Figure 2:
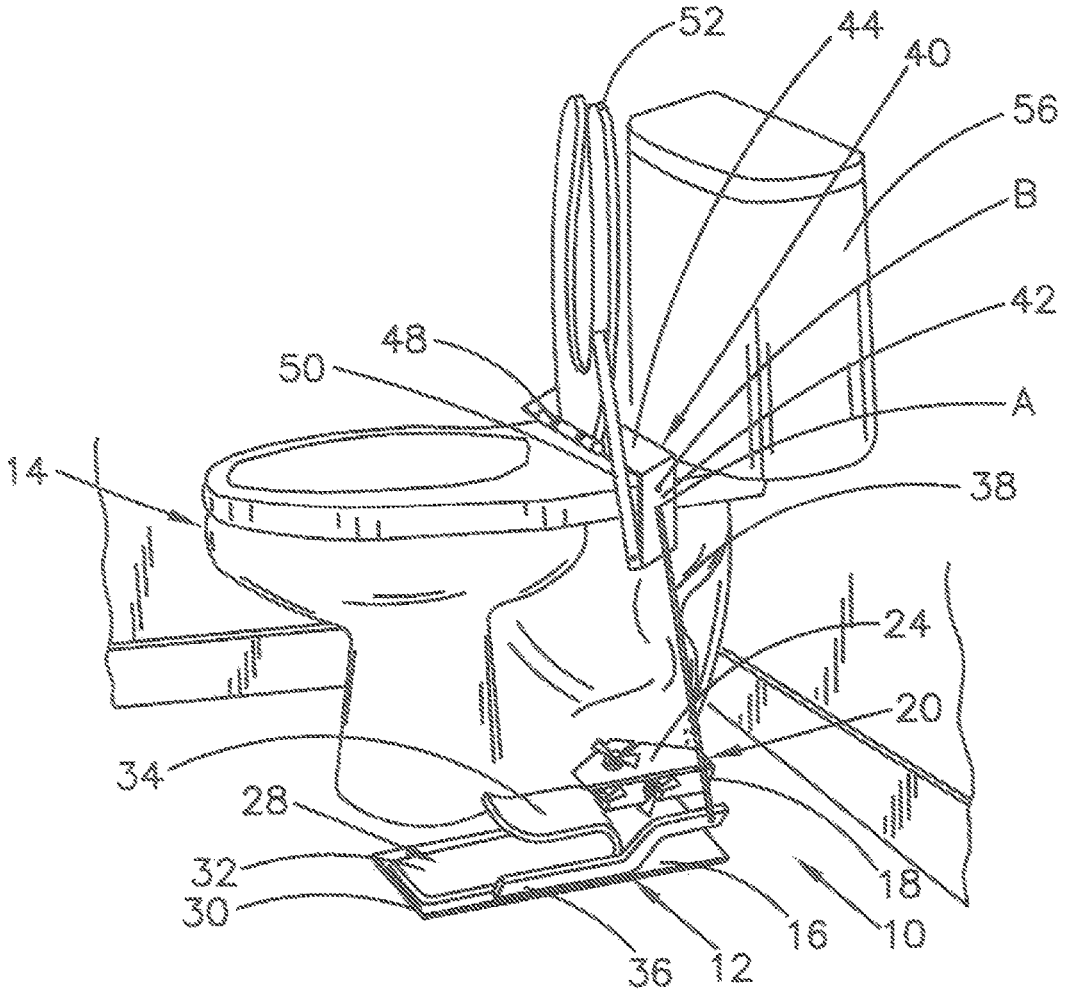
FIG. 2 is perspective view of the lifter device and toilet of FIG. 1 with the lifter biasing the toilet seat in a raised configuration.

In accordance with the exemplary embodiments, a toilet seat lifter 10 includes a pedal base 12 that rests on the floor next to a toilet 14. The term toilet seat may be used herein to refer to any toilet seat toilet lid, or combination thereof. The pedal base 12 includes a first portion 16 and a second portion 18. In the illustrated exemplary embodiment, the first portion 16 is a rectangular, horizontal plate having a pair of substantially flat, planar surfaces, with a bottom surface in contact with a floor, and the second portion 18 is a rectangular, vertical plate extending from the first portion 16 away from the floor. The second portion 18 extends from the first portion 16 at a substantially right angle, although any angle can be used depending on the configuration of the lifter 10 and the toilet 14. The first and second portions 16, 18 may be unitarily formed or separately connected to one another. Different configurations for the pedal base 12 may be used, for example any rectilinear shape, curvilinear shape, or various combinations thereof, to conform to different toilets, meet size requirements, or for other utility and design considerations. The pedal base 12 may be made from a plastic, metal, ceramic, or composite material, or any combination thereof. In certain embodiments, the pedal base 12 is made from any stiff, lightweight material.

The pedal base 12 is connected to a mounting bracket 20 by one or more mechanical fasteners, for example by one or more bolt and wing nut combinations 22. The mounting bracket 20 includes a first part 24 and a second part 26. In the illustrated exemplary embodiment, the first part 24 is a pentagonal, horizontal plate having a pair of substantially flat, planar surfaces, and the second part 26 is a rectangular, vertical plate extending from the first part 24 towards the floor. The first part 24 has a slot for receiving one or more fasteners to connect to the toilet 14. In an exemplary embodiment the slot receives the existing mounting hardware from the base of the toilet. The second part 26 extends from the first part 24 at a substantially right angle, although any angle can be used depending on the configuration of the lifter 10 and the toilet 14. The first and second parts 24, 26 may be unitarily formed or separately connected to on another. Different configurations for the mounting bracket 20 may be used, for example any rectilinear shape, curvilinear shape, or various combinations thereof, to conform to different toilets, meet size requirements, or for other utility and design considerations. In various exemplary embodiments, the mounting bracket 20 is unitarily formed with the pedal base 12. If the mounting bracket 20 is unitarily formed with the pedal base 12, the second part 26 may be omitted and the first part 24 extends directly from the pedal base 12. The mounting bracket 20 may be made from a plastic, metal, ceramic, or composite material, or any combination thereof. In certain embodiments, the mounting bracket 20 is made from metal and is coated, for example with paint, to help prevent corrosion.

A pedal 28 is pivotally connected to pedal base 12, for example via a pedal hinge 30 or other suitable pivotal connection. The pedal includes a bottom 32, a toe lip 34 extending from the bottom 32, and an extension arm 36. In the illustrated exemplary embodiment, the bottom 32 is a substantially planar member with a bottom surface facing the pedal base 12 and an opposite top surface for receiving a user's foot. The toe lip 34 has a first curved section extending from the bottom 32 and a concave second curved section at its free end. The toe lip 34 receives upward force applied by a user's foot. The extension arm 36 extends from the pedal 28 and includes a first end, a second end, and an intermediate twist or S-shaped curved section. The bottom 32, toe lip 34, and extension 36 may be unitarily formed or separately connected in any combination. Different configurations for the pedal 28 may be used to conform to different toilets, meet size requirements, or for other utility and design considerations. The pedal 28 may be made from a plastic, metal, ceramic, or composite material, or any combination thereof. In certain embodiments, the pedal 28 is made from any stiff, lightweight material.

The pedal 28 is mechanically attached to a first end of a linkage member and an operating assembly having a lifter and a closer is connected to the second end of the linkage member. According to an exemplary embodiment, the linkage member is a connector rod 38 that connects the extension arm 36 and a seat bracket 40. The seat bracket 40 includes a first section 42 and a second section 44. The first section 42 includes a first aperture A and a second aperture B. The connector rod 38 may be selectively connected to the first aperture A or the second aperture B by a user. One or more mounting claws 46 extend from the second section 44. The mounting claws 46 connect to the seat hinge 48. In accordance with the exemplary embodiment, the mounting claws include a first hook portion and a first tab spaced by a slot for receiving the seat hinge 48. The mounting claws 46 are unitarily formed with the seat bracket 40 or separately connected. Although the exemplary mounting claws 46 are configured to engage a variety of seat hinges 48, removable mounting claws 46 may be utilized to allow for connections to different types of seat hinges 48. The size, shape, and configuration of the mounting claws 46 may be varied to conform to different toilets, meet size requirements, or for other utility and design considerations.

In the illustrated exemplary embodiment, the first section 42 is a rectangular, vertical plate and the second section 44 is a rectangular, vertical plate extending from the first section 42 at a substantially right angle. When connected to the seat hinge 48, the first section extends outside of the toilet 14. Different configurations for the seat bracket 40 may be used to conform to different toilets, meet size requirements, or for other utility and design considerations. The seat bracket 40 and connector rod 38 may be made from a plastic, metal, ceramic, or composite material, or any combination thereof. In certain embodiments, the seat bracket 40 and connector rod 38 are made from metal and are coated, for example with paint, to help prevent corrosion.

A lift lever 50 is moveably connected to the seat bracket 40, for example to the first section 42. The lift lever 50 is positionable underneath a toilet seat 52 and is locked in place via a notch or an indent 54 in the seat bracket 40. In various exemplary embodiments, the lift lever 50 is connected to the seat bracket 40 by a fastener with enough tolerance to allow sufficient movement of the lift lever 50, for example a bolt or rivet 9. The lift lever 50 is capable of movement in a horizontal plane and a vertical plane. In various other exemplary embodiments, the lift lever 50 may be connected to the seat bracket 40 by a hinge, for example a living hinge. In the illustrated exemplary embodiment, the lift lever 50 is an elongate, substantially rectangular member, although different configurations may be used to conform to different toilets, meet size requirements, or for other utility and design considerations. The lift lever 50 may be made from a plastic, metal, ceramic, or composite material, or any combination thereof. In certain embodiments, the lift lever 50 is made from metal and is coated, for example with paint, to help prevent corrosion.

In operation, the pedal base 12 is placed next to the toilet 14 and the mounting bracket 20 is connected to the base of the toilet 14. The seat bracket 40 is connected to the toilet seat hinge 48 and the lift lever 50 is positioned under the toilet seat 52. It may be necessary to temporarily loosen the existing toilet seat hinge 48 bolts upon initial installation of the seat bracket 40 to allow room in the toilet hinge for 48 the mounting claws 46. In an exemplary embodiment, the toilet hinge 48 bolts are tightened with the mounting claws 46 in place to allow space for the mounting claws 46 to be easily inserted or removed in subsequent installation and removal of the seat bracket 40, for example without further adjusting or loosening the seat hinge 18. When connected to the seat hinge 48, the first section 42 of the seat bracket 40 extends outside the edge of the toilet 14.

Figure 3:
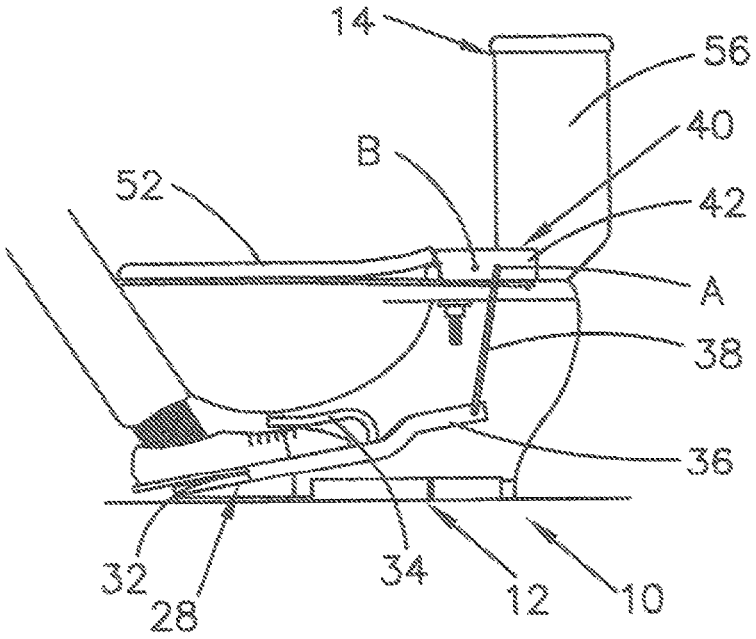
FIG. 3 is a side elevational view of the lifter device and toilet in a first exemplary configuration where a connector rod is connected in a first position and with a depiction of a user's foot.

The pedal 28 is connected to the seat bracket 40 by connector rod 38 connected to either aperture A or B. As depicted in FIG. 3, and in accordance with various exemplary embodiments, when a user steps on the pedal 28 and applies downward pressure, the pedal 28 is pivoted towards the pedal base 12, moving the extension arm 36 and the connector rod 38 downward, pulling down the first section 42 of the seat bracket 40, and pivoting the seat bracket 40 on the toilet hinge 48. As the seat bracket 40 pivots, the lift lever 50 raises the toilet seat 52 to a raised position. When the toilet seat is raised, a user may move their foot upwards, applying force to the toe lip 34 and lifting the pedal 28. Upward movement of the pedal 28 moves the extension arm 36 and the connector rod 38 upward, which pushes up the first section 42 of the seat bracket 40 and moves the lift lever 50 back towards the toilet 14. The rotation of the seat bracket 40 to its initial position causes it to engage the toilet seat 52 and move the toilet seat 52 to an initial or lowered position.

Figure 4:
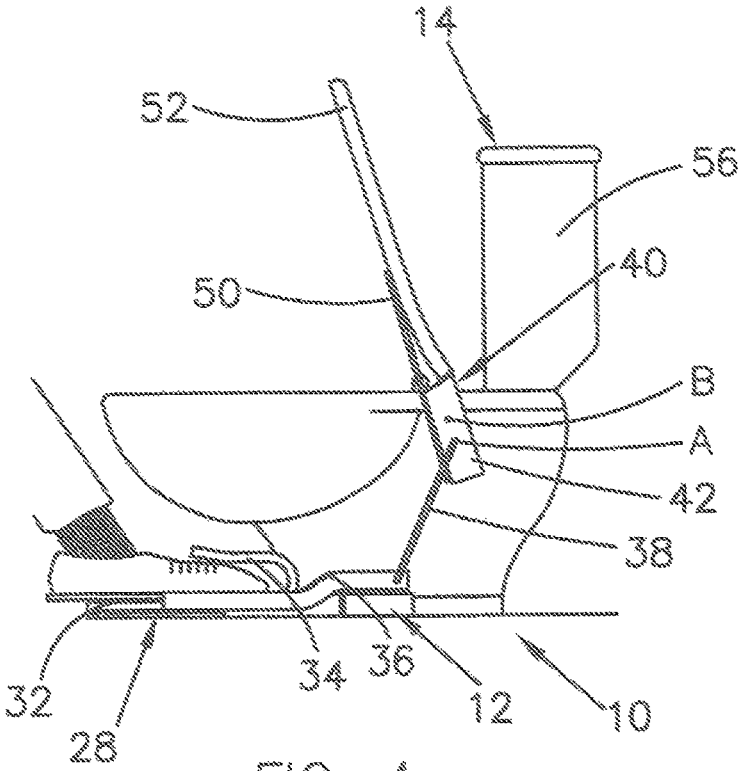
FIG. 4 is a side elevational view of the lifter device and toilet of FIG. 3 with the user biasing the toilet seat into the raised configuration at a less than vertical position.
Figure 5:
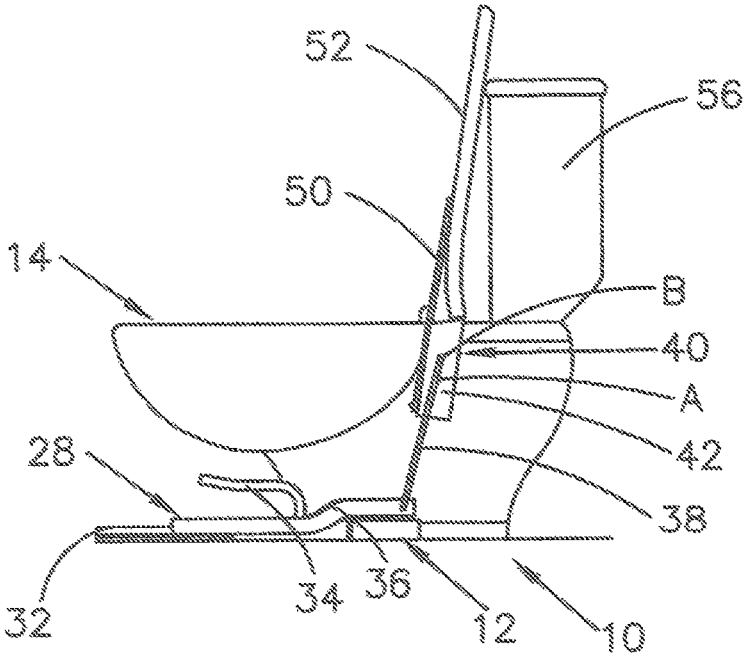
FIG. 5 is a side elevational view of the lifter device and toilet in a second exemplary configuration where a connector rod is connected in a second position and where the toilet seat is raised past a vertical position.
Figure 6:
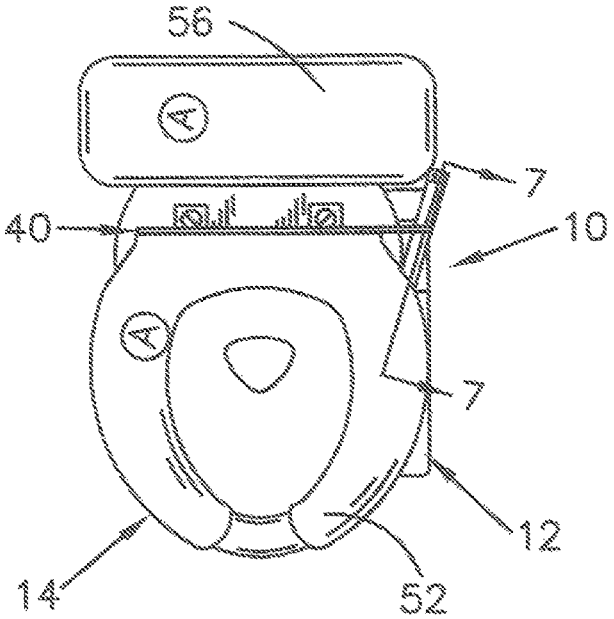
FIG. 6 is a top plan view of the lifter device and toilet of FIG. 1.
Figure 7:
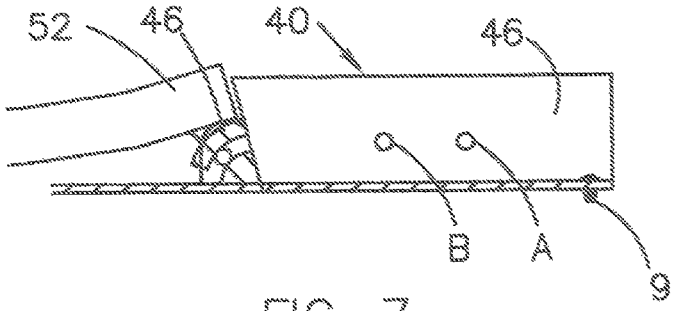
FIG. 7 is a side sectional view of the seat bracket taken about line 7-7.
Figure 8A:
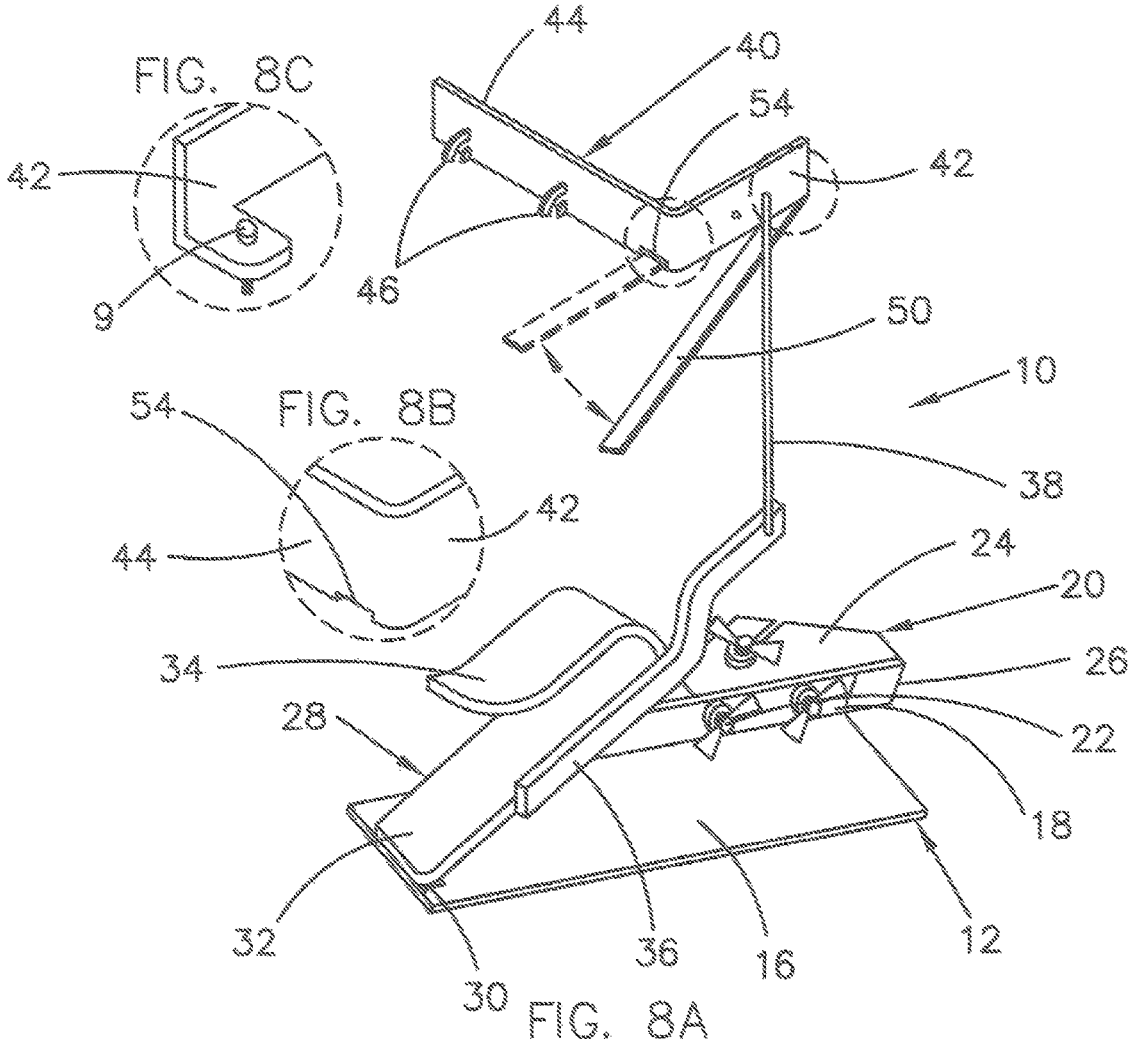
FIG. 8A is a perspective view of the lifter device of FIG. 1 removed from the toilet.
Figure 9:
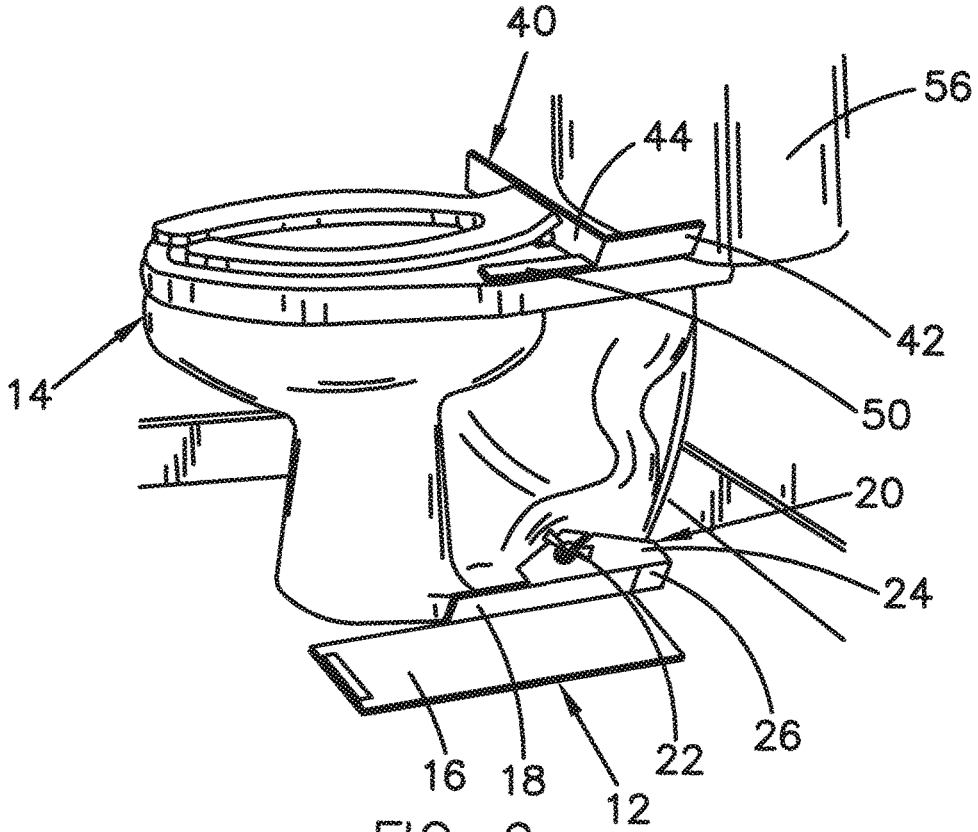
FIG. 9 is a perspective view of the pedal base and seat bracket mounted to the toilet with the pedal and connector rod removed.

As shown in FIG. 4, placement of connector rod 38 in aperture A causes the lift lever 50 to lift the toilet seat 52 to a less than vertical position so that the toilet seat 52 returns to the lowered position upon removal of the force from user's foot. As shown in FIG. 5, placement of connector rod 38 in aperture B lifts the toilet seat 52 to a beyond vertical position, for example with the toilet seat 52 resting against the toilet tank 56, so that toilet seat 52 remains raised when force from a user's foot is removed. The seat 52 is then lowered by a user moving the pedal 28 upward.

Accordingly, the various exemplary embodiments described provide a toilet seat lifting and lowering device using a single pedal 28 and a user option for the seat 52 to automatically return to a lowered position or for the seat 52 to return to a lowered position by application of a force to the toe lip 34. The single pedal 28 is capable of both raising and lowering a toilet seat 52. The various exemplary embodiments described also provide a device capable of being installed and removed for ease of use and maintenance (e.g., cleaning) of the toilet 14. In various exemplary embodiments, the lifter device 10 is configured to retro-fit to existing toilet seats. The lifter device 10 allows user to avoid/minimize physical skin contact (disease transmission) and prevent strenuous effort/exertion of back, spine, shoulders etc. required to manually lower and raise a toilet seat 52.

In various exemplary embodiments, the pedal base 12 is not mounted to the toilet 14. For example, the pedal base 12 could be sufficiently heavy to provide stability and prevent movement during use. In another alternative embodiment, the pedal base 12 is secured to the floor, for example using a mechanical connection such as fasteners, or an adhesive connection such as tape or glue. Although the exemplary embodiments depict a lifter 10 configured to be positioned on the right side of the toilet 14, the lifter 10 may be configured to be positioned on the left side of the toilet 14 or configured to be selectively positioned on either side of the toilet 14 by a user.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the precise embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present invention, and are not intended to limit the structure of the exemplary embodiments of the present invention to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A toilet seat lifting device comprising:

a pedal base;

a pedal pivotally connected to said pedal base;

a seat bracket mechanically connected to said pedal by a connector rod, wherein said seat bracket includes a first aperture and a second aperture selectively receiving said connector rod and movement of said pedal causes movement of said seat bracket; and a lifter lever connected to, and extending outwardly from, said seat bracket, wherein movement of said pedal causes movement of said lifter lever to a less than vertical orientation when said connector rod is connected to said first aperture and movement of said pedal induces movement of said lifter lever past a vertical orientation when said connector rod is connected to said second aperture.

2. The device of claim 1, wherein said pedal comprises a toe lip to receive a user's foot and allow an upward force to be applied to said pedal.

3. The device of claim 1, wherein said pedal is pivotally connected to said pedal base by a hinge.

4. The device of claim 1, wherein said seat bracket comprises a mounting claw.

5. The device of claim 1, wherein said seat bracket comprises an indent to receive said lifter lever.

6. A toilet seat lifting device comprising:

a pedal base having a first portion and a second portion extending from the first portion;

a mounting bracket extending from said pedal base having a slot;

a pedal pivotally connected to said pedal base having a bottom and a toe lip;

a seat bracket mechanically coupled to said pedal so that downward movement of said pedal induces movement of said seat bracket in a first direction and upward movement of said pedal induces movement of said seat bracket in a second direction; and a lifter lever connected to, and extending outwardly from, said seat bracket.

7. The device of claim 6, wherein said mounting bracket includes a first part and a second part extending from said first part and connected to said second portion of said pedal base.

8. The device of claim 6, wherein said mounting bracket is unitarily formed with said pedal base.

9. A toilet and toilet seat lifting device combination comprising:

a toilet having a toilet base, a toilet seat connected to said toilet base by a seat hinge, and a tank;

a pedal base;

a mounting bracket extending from said pedal base and connected to said toilet base;

a pedal pivotally connected to said pedal base;

a seat bracket connected to said seat hinge and coupled to said pedal so that movement of said pedal induces movement of said seat bracket; and a lifter lever connected to said seat bracket and positionable under said toilet seat so that application of a force to said pedal causes movement of said toilet seat, wherein said seat bracket is removable from said seat hinge without loosening said seat hinge.

10. The combination of claim 9, wherein said mounting bracket is connected to said pedal base by at least one mechanical fastener.

11. The combination of claim 9, wherein said mounting bracket comprises a slot for receiving existing mounting hardware of said toilet.

12. The combination of claim 9, wherein downward movement of said pedal causes said lifter to raise said toilet seat and upward movement of said pedal causes said seat bracket to lower said toilet seat.

13. The combination of claim 9, wherein said seat bracket comprises at least one mounting claw connecting said seat bracket to said toilet hinge.

14. The combination of claim 9, wherein a downward force applied to said pedal causes said seat bracket to pivot about said toilet seat hinge.

15. The combination of claim 9, wherein said seat bracket comprises a first aperture and a second aperture for selectively coupling said pedal to said seat bracket, and wherein movement of said pedal induces movement of said lifter lever to a less than vertical orientation when said connector rod is connected to said first aperture and movement of said pedal induces movement of said lifter lever to past a vertical orientation when said connector rod is connected to said second aperture.

16. The combination of claim 15, wherein said toilet seat is lowered upon removal of a downward force from said pedal when said connector rod is connected to said first aperture and said toilet seat is lowered upon application of an upward force to said pedal when said connector rod is connected to said second aperture.

17. A device for raising or lowering a toilet seat comprising:

a foot pedal disposed proximate a surface supporting a toilet;

a linkage member mechanically attached to said foot pedal at a first end thereof;

an operating assembling mechanically attached to said linkage member at a second end thereof and having a lifter for raising said toilet seat when said foot pedal is depressed and a closer for closing said toilet seat when said foot pedal is raised, wherein said lifter includes a flat portion disposed under said toilet seat and said closer and said lifter contacts a side portion of said toilet seat and said closer contacts a rear portion of said toilet seat.

18. A toilet seat lifting device comprising:

a pedal base;

a pedal pivotally connected to said pedal base;

a seat bracket mechanically connected to said pedal, wherein movement of said pedal causes movement of said seat bracket and wherein said seat bracket is configured to be connected to and removable from a toilet seat hinge without loosening said seat hinge; and a lifter lever connected to, and extending outwardly from, said seat bracket.

* * * * *